US005780934A

United States Patent [19]

Imanishi et al.

[11] Patent Number: 5,780,934

[45] Date of Patent: Jul. 14, 1998

[54] STARTER WITH PINION REGULATING CLAW AND SPRING

[75] Inventors: Tetsuo Imanishi, Chita-gun; Nobuyuki Hayashi, Nagoya, both of Japan

[73] Assignee: Denso Corporation

[21] Appl. No.: 773,319

[22] Filed: Dec. 24, 1996

[30] Foreign Application Priority Data

Dec. 26, 1995 [JP] Japan ..... 7-339558

[51] Int. Cl.[6] ..... F02N 11/00

[52] U.S. Cl. ..... 290/38 R; 290/48

[58] Field of Search ..... 290/38 R, 48, 290/38 A, 38 B, 38 C; 74/7 R, 7 A, 7 E, 6; 310/78

[56] References Cited

U.S. PATENT DOCUMENTS 5,610,445 3/1997 Shiga et al. ..... 290/38 R

*Primary Examiner*—Steven L. Stephan

*Assistant Examiner*—Judson H. Jones

*Attorney, Agent, or Firm*—Cushman Darby & Cushman Intellectual Property Group of Pillsbury Madison & Sutro, LLP

[57] ABSTRACT

In a starter, one end of a spring is connected with a pinion, whereas the other end of the spring is connected with an annular plate. A regulation claw of a regulation member for moving the pinion toward a ring gear is made separate from the spring which is flexed in the rotational direction of an output shaft so as to engage the pinion with the ring gear, when the pinion is brought into contact with the ring gear. Thus, appropriate setting of the specification of the regulation claw of the regulation member and that of the spring can be very easily accomplished. Further, because the specification of the spring can be independently appropriately set without difficulty, the spring is made more durable.

9 Claims, 3 Drawing Sheets

STARTER WITH PINION REGULATING CLAW AND SPRING

BACKGROUND OF THE INVENTION

1. Field of the Invention

The present invention relates to a starter for starting an engine.

2. Description of Related Art

In a starter such as disclosed in Australian Laid-Open Patent Publication No. 81530/94, which is a counterpart of U.S. application Ser. No. 08/567,211 filed on Dec. 5, 1995 which is in turn a continuation of U.S. application Ser. No. 08/353,987 filed on Dec. 6, 1994, a regulation claw of a pinion regulation member radially inwardly engages a concave formed on the peripheral surface of a pinion due to the movement of the plunger of a magnet switch. When the pinion is brought into contact with an engine ring gear owing to the movement of the pinion toward the ring gear caused by the rotation of the output shaft, the pinion regulation member flexes in the rotational direction of a starter output shaft to allow the rotation of the pinion. As a result, the pinion is capable of engaging the ring gear.

In this starter, it is necessary to perform the operation of moving the pinion regulation member toward the pinion radially inwardly and the operation of flexing the pinion regulation member so that the pinion is rotated by ½ pitches when the pinion contacts the ring gear. In the former operation, the degree of the load to be applied to the pinion regulation member is small because the pinion regulation member only moves toward the pinion radially inwardly to regulate the rotation of the pinion, whereas in the latter operation, the force for moving the pinion forward is generated, with the pinion regulation member flexed to allow the engagement between the ring gear and the pinion which contacts the ring gear. Thus, the pinion regulation member is subjected to a large load. It is favorable for reducing the number of parts of the starter that the two operations are performed by only one member, namely, by only the pinion regulation member. However, in performing the latter operation, the position of the pinion regulation member at which it contacts the pinion, namely, the position of the concave of the pinion into which the pinion regulation member is engagedly fitted shifts greatly. Thus, each time the position of the concave into which the pinion regulation member is engagedly fitted shifts, the pinion regulation member is repeatedly flexed. Therefore, it is necessary to set the specification of the pinion regulation member in consideration of durability thereof. Moreover, in order for one member to perform the two operations, necessarily, the pinion regulation member has a complicated construction. The pinion regulation member is required to have a part for regulating the rotation of the pinion and a part for flexing it. It is very difficult to accomplish such a setting.

Further, it is necessary to change the specification of the pinion gear depending on the specification (chamfering, module, number of teeth, and the like) of the ring gear of the engine. Thus, it is necessary to form a concave, on the peripheral surface of each pinion, into which the pinion regulation member is fitted.

SUMMARY OF THE INVENTION

The present invention has an object to provide a starter having an improved engagement structure between a pinion gear and a ring gear.

The present invention has an additional object to provide a starter having a construction appropriately set to move a pinion gear toward a ring gear and a construction appropriately set to flex a pinion regulation member in the rotational direction of a starter output shaft when the pinion gear contacts the ring gear.

According to one aspect of the present invention, one end of an elastic member is connected with a first moving member having a pinion gear formed thereon and the other end thereof is connected with a second moving member. Thus, a regulation member for moving the pinion gear toward the ring gear is formed separately from the elastic member which is flexed in the rotational direction of an output shaft so as to engage the pinion gear with the ring gear, when the pinion gear is brought into contact with the ring gear. Therefore, appropriate setting of the specification of the regulation member and the elastic member can be facilitated. Further, due to the rotation of the output shaft, the first moving member is moved toward the ring gear in cooperation with the regulation member, the second moving member, and the elastic member, with the regulation member in contact with the second moving member. When the pinion gear contacts the ring gear, the first moving member can be rotated by more than ½ pitch of the pinion gear with respect to the second moving member, owing to the flexure of the elastic member in the rotational direction of the output shaft caused by the rotation thereof. Consequently, the pinion gear engages the ring gear reliably, and the teeth of the pinion gear and that of the ring gear can be prevented from being broken. Further, because the regulation member is separate from the elastic member, the specification of the elastic member can be independently appropriately set without difficulty.

Preferably, when the pinion serves as the first moving member and is brought into contact with the ring gear, the elastic member is flexed in the rotational direction of the output shaft. Thus, shocks which occur as a result of the collision between the pinion gear and the ring gear can be absorbed.

Preferably, although it is necessary to alter the specification of the pinion gear depending on the load to be applied to an engine and the specification (number of teeth, module, chamfering) of the ring gear of the engine, the first moving member comprises the pinion gear which engages the first helical spline formed on the output shaft; and the elastic member-holding part which engages a helical spline of the output shaft and is connected with the elastic member so as to hold the second moving member through the elastic member, and the pinion gear is separate from the elastic member-holding part. Therefore, members located rearward from the pinion gear to the motor, namely, the elastic member-holding part, the second moving member, and the regulation member can be used commonly in various starters although the replacement of the pinion gear is required depending on starters. That is, a starter can be assembled easily and manufactured with a high productivity at a low cost.

Preferably, a force for returning the first moving member toward a motor-located side is generated due to a change in the load to be applied to the engine in driving the engine, with the pinion gear in engagement with the ring gear. At this time, the regulation member is located rearward (motor-located side) from the second moving member, thus preventing the backward movement of the first moving member through the elastic member. Hence, it is unnecessary provide a member for preventing the backward movement of the first moving member.

More preferably, a thrust bearing is interposed between the second moving member and the regulation member to absorb the difference between the number of rotations of the second moving member and that of the regulation member. Thus, it is possible to suppress the generation of abrasion, heat, and rotational loss between the second moving member and the regulation member. Further, even though the second moving member is subjected to the rotation of the ring gear transmitted through the first moving member and the elastic member and even though the first moving member is subjected to a force for returning it to the starter motor-located side, the thrust bearing absorbs the difference between the number of rotations of the second moving member and that of the regulation member. Thus, it is possible to suppress the generation of abrasion, heat, and rotational loss between the second moving member and the regulation member. Accordingly, the performance of the starter can be maintained for a long time.

According to another aspect of the present invention, an elastic member interlocks a pinion gear and a plate elastically with each other, a regulation member for moving the pinion gear toward a ring gear is formed separately from the elastic member which is flexed in the rotational direction of a starter output shaft so as to engage the pinion gear with the ring gear, when the pinion gear is brought into contact with the ring gear. Therefore, appropriate setting of the specification of the regulation member and the elastic member can be facilitated. Further, due to the rotation of the output shaft, the regulation member moves the pinion toward the ring gear in cooperation with the second moving member and the elastic member, with the regulation member in contact with the second moving member. When the pinion gear contacts the ring gear, the pinion gear engages the ring gear reliably owing to the flexure of the elastic member in the rotational direction of the output shaft caused by the rotation thereof. Thus, the teeth of the pinion gear and that of the ring gear can be prevented from being broken. Further, because the regulation member is separate from the elastic member, the specification of the elastic member can be independently appropriately set without difficulty.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF PRESENTLY PREFERRED EMBODIMENTS

Figure 1:
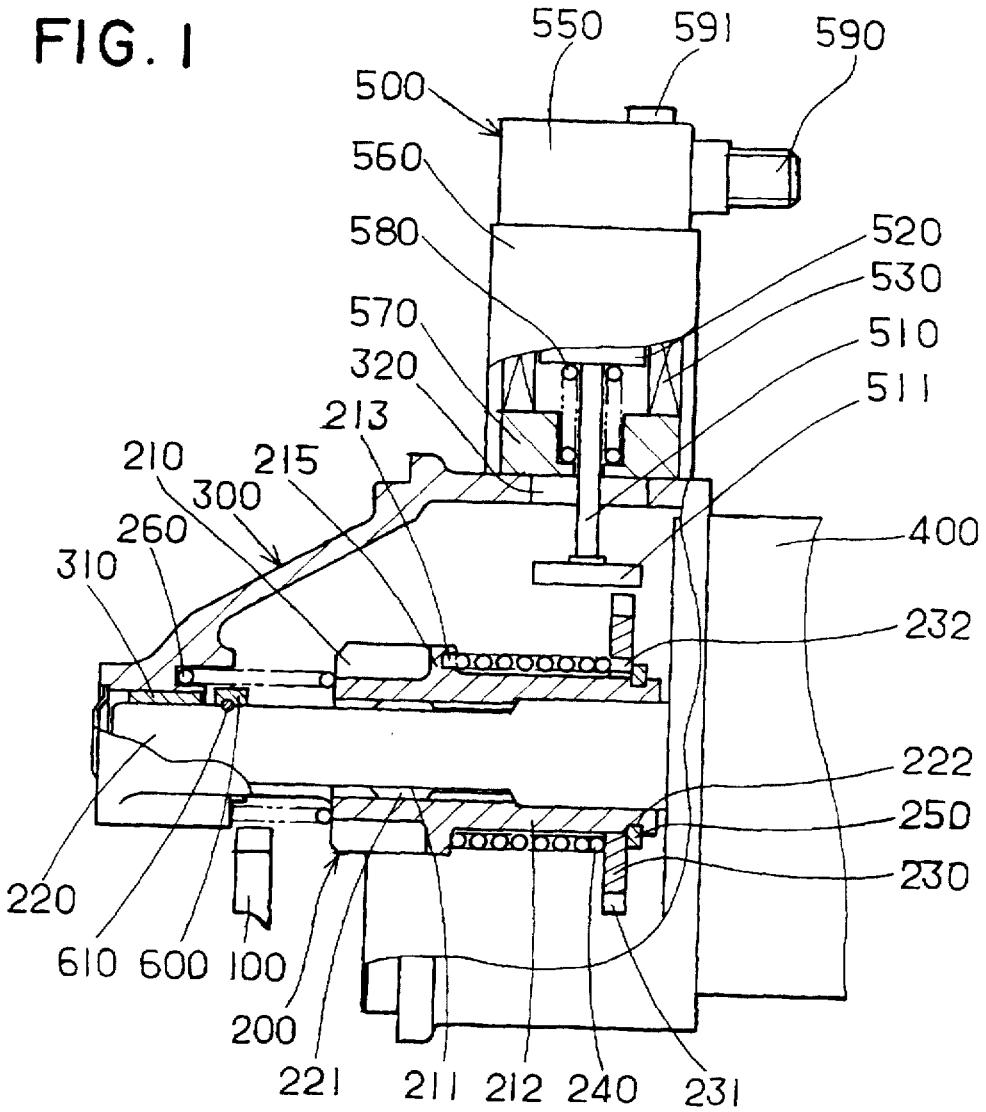
FIG. 1 is a partially sectional view of a starter according to a first embodiment of the present invention.

Various embodiments of the present invention is described below with reference to the accompanying drawings in which the same or similar structural parts are denoted by the same reference numerals.

(First Embodiment)

A starter is divided, as shown in FIG. 1, into a housing 300 accommodating a pinion 200 having a pinion gear 210 formed thereon for engagement with a ring gear 100 mounted on an engine; a motor 400; and a magnet switch 500 which supplies an electric power to the motor 400.

The pinion gear 210 which engages the ring gear 100 of the engine is formed on the pinion 200. A pinion helical spline 211 which mates with a helical spline 221 formed on an output shaft 220 is formed on the inner peripheral surface of the pinion gear 210. The pinion 200 has a pinion cylindrical portion 212 which extends in the direction opposite to the ring gear-located side (motor side) and is formed integrally with the pinion gear 210. An annular plate 230 which engages a regulation member 510 is inserted into the peripheral surface of the pinion cylindrical portion 212 at a portion thereof opposite to the ring gear-located side. The plate 230 is held rotatably around the pinion cylindrical portion 212. A concave 231 is formed at plural locations on the entire peripheral surface of the plate 230. The number of the concaves 231 is greater than that of the external teeth of the pinion gear 210. A regulation claw 511 of the regulation member 510 is placed engageably with the concave 231.

A coil spring 240 elastic in the axial and circumferential directions of the pinion cylindrical portion 212 is provided on the peripheral surface of the pinion cylindrical portion 212 in the range between the pinion 200 and the plate 230. One end of the coil spring 240 is inserted into an engaging hole 213 formed on a flange 215 of the pinion gear 210 so that one end of the coil spring 240 is connected with the flange 215, whereas the other end of the coil spring 240 is inserted into an engaging hole 232 formed on the plate 230 so that the other end of the coil spring 240 is connected with the plate 230. When the pinion gear 210 contacts the ring gear 100 by its leftward movement in the figure, the coil spring 240 is flexed due to the rotation of the output shaft 220 so that the pinion 200 rotates more than ½ pitch of the pinion gear 210 with respect to the plate 230.

A snap ring 250 is inserted into a groove 222 formed on the pinion cylindrical portion 212 at an end thereof opposite to the ring gear-located side to prevent the plate 230 from being removed from the pinion cylindrical portion 212. The pinion gear 210 is normally biased toward the motor-located side by a return spring 260 consisting of a compression coil spring.

The regulation member 510 comprises a plunger 520 of the magnet switch 500 and the regulation claw 511 fixed to one end of the plunger 520. The regulation claw 511 is engageable with the concave 231 of the plate 230.

An output shaft 220 is supported rotatably by a housing bearing 310 fixed to the housing 300 at the inner front end thereof. The housing 300 has an opening portion 320, formed thereon, through which the regulation claw 511 mounted on one end of the plunger 520 is inserted.

The magnet switch 500 is fixed substantially perpendicularly to the housing 300 or radially to the shaft 220. A battery terminal 590 to which an electric power is supplied from an unshown battery and a switch terminal 591 connected with an exiting coil 530 installed radially outside the peripheral surface of the plunger 520 are mounted on a magnet switch cover 550 made of resin. The magnet switch cover 550 closes one opening of a cylindrical magnet switch yoke 560 made of a magnetic material. The plunger 520 is installed on the inner peripheral surface of the magnet switch yoke 560. The other opening of the magnet switch yoke 560 is closed by a stationary core 570 on which a plunger return spring 580 normally biasing the plunger 520 toward the magnet switch cover 550 is installed. The stationary core 570 has a hole formed at approximately its radial center to support the plunger 520 thereby.

A pinion stopper 600 is fixed to an annular groove formed on the peripheral surface of the output shaft 220 through a snap ring 610.

The starter according to the first embodiment operates as follows.

When the coil 530 of the magnet switch 500 is energized with electric current, the plunger 520 is attracted by a magnetic force generated by the coil 530 and the plunger 520 moves downward in the figure.

The regulation claw 511 engages one of the concaves 231 of the plate 230. At this time, an unshown movable contact coupled with the plunger 520 contacts an unshown fixed contact in the magnet switch 500 to supply the electric power to the motor 400. As a result, the motor 400 starts to rotate, and then the output shaft 220 starts to be rotated by the motor 400.

Because the coil spring 240 connects the plate 230 and the pinion 200 therethrough, the output shaft 220 applies a rotational force to the pinion 200. Because the regulation claw 511 prevents the rotation of the plate 230 at this time, the pinion 200 moves forward along the helical spline 221 of the output shaft 220.

As a result of the forward movement of the pinion 200, the pinion gear 210 contacts the ring gear 100. When the end face of the pinion gear 210 is brought into contact with that of the ring gear 100, the forward movement of the pinion gear 210 is prevented. With further rotation of the output shaft 220, the pinion 200 flexes the coil spring 240 in the rotational direction of the output shaft 220. When the teeth of the pinion gear 210 and the ring gear 100 aligns properly to each other for engagement, the pinion gear 210 advances further engages the ring gear 100 completely. Then, the pinion gear 210 contacts the pinion stopper 600. With forward movement of the pinion gear 210, the regulation claw 511 which slides in the concave 231 of the plate 230 moving together with the pinion 200 disengages finally from the concave 231 of the plate 230. Then, the plunger 520 moves downward further. As a result, the front end of the regulation claw 511 is placed rearward of or axially behind the plate 230.

When the end face of the pinion gear 210 is not brought into contact with that of the ring gear 100, but when the pinion gear 210 engages the ring gear 100 immediately, the coil spring 240 is not flexed and the pinion gear 210 engages the ring gear 100 completely.

When the ring gear 100 of the engine rotates faster than the pinion gear 210 as a result of the rotation of the engine, the pinion gear 210 comes to have a backward moving force generated due to the action of the helical splines. The regulation claw 511 located behind the plate 230 prevents the backward movement of the pinion gear 210, thus preventing the pinion gear 210 from being disengaged from the ring gear 100 in a short period of time. Thus, the engine can be started assuredly.

When the engine starts, the supply of electric power to the coil 530 of the magnet switch 500 is stopped so that the plunger 520 is moved upward by the plunger return spring 580 and returned to the normal or initial position, and the regulation claw 511 moves away from the rear of the plate 230. As a result, the pinion gear 210 is moved backward by the action of the return spring 260 and disengages from the ring gear 100, thus being returned to the normal or initial position at which the pinion gear 210 is positioned before the starter starts. At this time, the unshown movable contact disengages from the unshown fixed contact, with the result that the supply of the electric power to the motor 400 is stopped, and the rotation of the motor 400 and that of the output shaft 220 are also stopped.

According to the above-described embodiment, one end of the coil spring 240 is connected with the pinion 200 having the pinion gear 210 formed thereon, whereas the other end of the coil spring 240 is connected with the plate 230. Further, the regulation claw 511 of the regulation member 510 for moving the pinion gear 210 toward the ring gear 100 is formed separately from the coil spring 240 which is flexed in the rotational direction of the output shaft 220 so as to enable the engagement between the pinion gear 210 and the ring gear 100, when the pinion gear 210 is brought into contact with the ring gear 100. Thus, the specification of the regulation claw 511 and that of the coil spring 240 can be appropriately set with ease.

Further, due to the rotation of the output shaft 220, the regulation claw 511 of the regulation member 510 moves the pinion 200 toward the ring gear 100 in cooperation with the plate 230 and the coil spring 240, with the regulation claw 511 of the regulation member 510 in contact with the plate 230. When the pinion gear 210 contacts the ring gear 100, the pinion 200 can be rotated by more than ½ pitch of the pinion gear 210 with respect to the plate 230, owing to the flexure of the coil spring 240 in the rotational direction of the output shaft 220 caused by the rotation of the output shaft 220. Accordingly, the pinion gear 210 engages the ring gear 100 reliably, and hence the tooth of the pinion gear 210 and that of the ring gear 100 can be prevented from being broken. Further, because the regulation claw 511 of the regulation member 510 is separate from the coil spring 240, the specification of the coil spring 240 can be independently appropriately set without difficulty, resulting in higher durability.

Moreover, when the pinion gear 210 of the pinion 200 is brought into contact with the ring gear 100, the coil spring 240 is flexed in the rotational direction of the output shaft 220. Thus, shocks which occur as a result of the contact collision between the pinion gear 210 and the ring gear 100 can be absorbed, and further, the tooth of the pinion gear 210 and that of the ring gear 100 can be prevented from being broken.

Further, a force for returning the pinion 200 toward the motor-located side is generated due to a change in the load applied to the engine in driving the engine, with the pinion gear 210 in engagement with the ring gear 100. At this time, the regulation claw 511 of the regulation member 510 is located rearward (motor-located side) from the plate 230, thus preventing the backward movement of the pinion 200 through the coil spring 240. Hence, it is unnecessary to provide an additional member for preventing the backward movement of the pinion 200.

(Second Embodiment)

Figure 2:
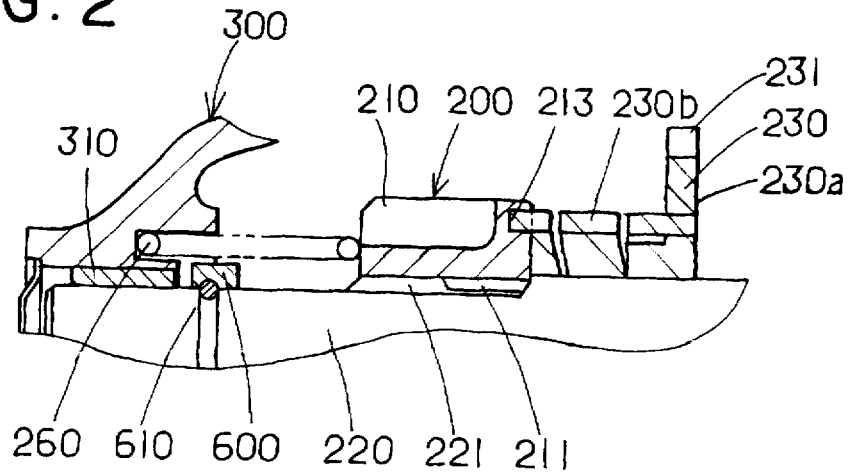
FIG. 2 is a partially sectional view of a starter according to a second embodiment of the present invention.
Figure 3:
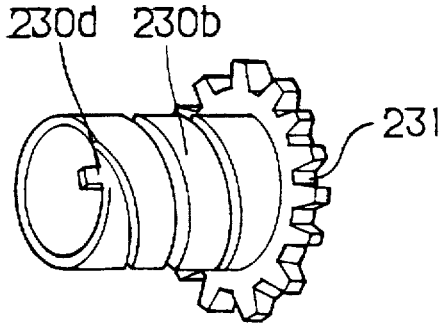
FIG. 3 is a perspective view showing a plate used in the second embodiment shown in FIG. 2.

In the second embodiment shown in FIGS. 2 and 3, the annular plate and the coil spring are made integral with each other, unlike in the first embodiment. That is, the plate 230 comprises a large-diameter part **230*a* and an elastic part 230*b*. The concave 231 is formed on the entire peripheral surface of the large-diameter part 230*a*. The number of the concaves 231 is greater than that of the external teeth of the pinion gear 210. Similarly to the first embodiment, the regulation claw 511 of the regulation member 510 is driven to engage one of the concaves 231**.

The elastic part **230*b* is made of a plate wound cylindrically and spirally to be elastic in the axial and circumferential directions of the plate 230. An end of the elastic part 230*b* projects axially to form a projected portion 230*d*. Similarly to the first embodiment, the projected portion 230*d* is press-fitted into the engaging hole 213 of the pinion gear 210. The plate 230 moves together with the pinion gear 210** along the output shaft 220 so that the second embodiment operates similarly to the first embodiment.

(Third Embodiment)

Figure 4:
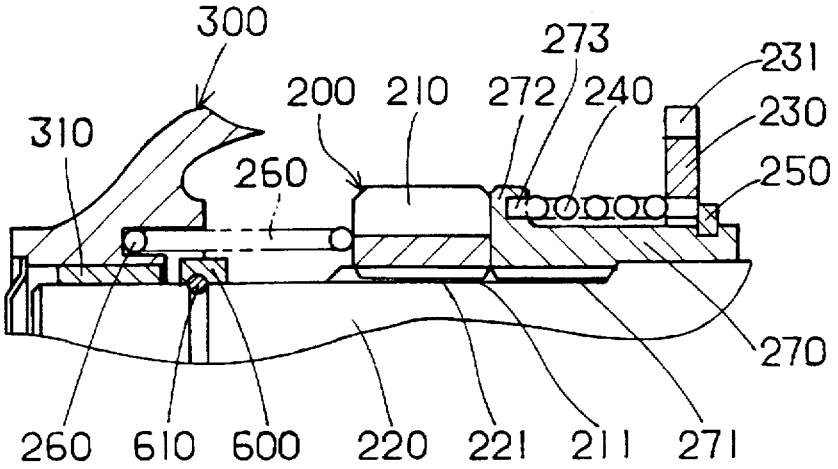
FIG. 4 is a partially sectional view of a starter according to a third embodiment of the present invention.

In the third embodiment shown in FIG. 4, unlike in the first embodiment, the pinion 200 is divided into the pinion gear 210 and a coil spring-holding member 270. Similarly to the first embodiment, the pinion helical spline 211 which mates with the helical spline 221 formed on the output shaft 220 is formed on the inner peripheral surface of the pinion gear 210. Similarly to the pinion gear 210, a helical spline 271 is formed on the inner peripheral surface of the coil spring-holding member 270. An engaging hole 273 to which the coil spring 240 is fixed is formed on a flange 272 of the coil spring-holding member 270.

The pinion gear 210 is engaged by the pinion helical spline 211 of the output shaft 220 and normally urged toward the coil spring-holding member 270 by the return spring 260, with the pinion gear 210 in contact with the coil spring-holding member 270 separably. The plate 230 is held movable along the coil spring-holding member 270.

In addition to the advantages of the first embodiment, the third embodiment provides the advantage that members located rearward from the pinion gear 210 to the motor, namely, the coil spring-holding member 270, the plate 230, and the regulation claw 511 of the regulation member 510 can be used commonly in various starters, although the replacement of the pinion gear 210 is required depending on starters. Thus, the third embodiment provides a starter which can be assembled easily and manufactured with a high productivity at a low cost.

(Fourth Embodiment)

Figure 5:
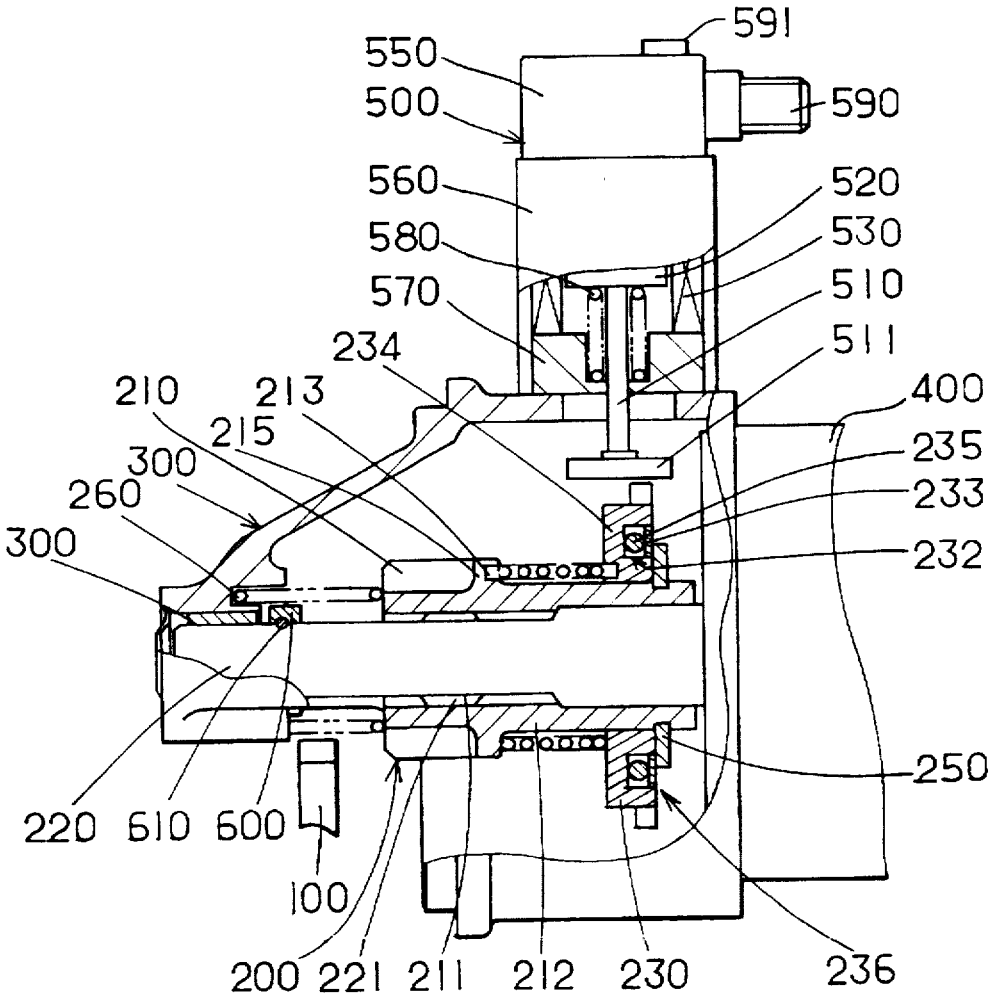
FIG. 5 is a partially sectional view of a starter according to a fourth embodiment of the present invention.

In the fourth embodiment shown in FIGS. 4 and 5, a thrust bearing 232 is provided radially inside the plate 230, unlike in the first embodiment. The thrust bearing 232 for absorbing the difference between the number of rotations of the plate 230 and that of the regulation claw 511 of the regulation member 510 is provided on the rear surface of a roller-holding part 234 of the plate 230. A bearing capable of applying an axial load is generally called a thrust bearing.

As the thrust bearing 232, a roller bearing is adopted. The thrust bearing 232 comprises a bearing ring 233 which contacts the front end of the regulation claw 511 of the regulation member 510 and a plurality of rollers or rollers 235 which rotate between the bearing ring 233 and the rear surface of the roller-holding part 234. The difference between the number of rotations of the plate 230 and that of the regulation claw 511 of the regulation member 510 is absorbed by the rotation of the rollers 235. Steel balls may be used as the rollers 235, but ceramic balls may be used as well to prolong the durability of the rollers 235.

Figure 6:
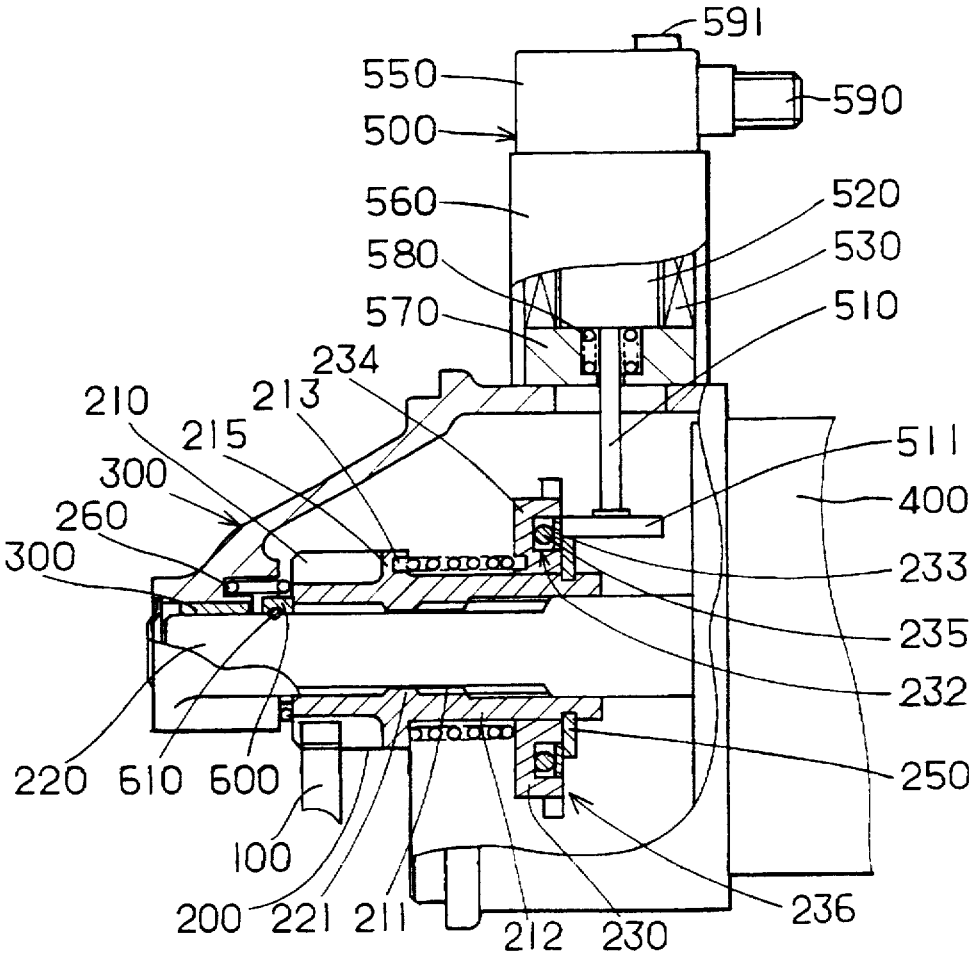
FIG. 6 is a partially sectional view showing an operation of the fourth embodiment shown in FIG. 5.

In this construction, because the rotatable thrust bearing 232 is provided on the rear surface of the roller-holding part 234 of the plate 230, when the regulation claw 511 of the regulation member 510 is located rearward from the plate 230 as shown in FIG. 6, the front end of the regulation claw 511 of the regulation member 510 contacts the bearing ring 233 of the thrust bearing 232. Accordingly, a rotation torque to be transmitted to the plate 230 through the pinion 200 and the coil spring 240 is absorbed by the thrust bearing 232. Thus, it is possible to suppress the generation of abrasion, heat, and rotational loss between the plate 230 and the regulation claw 511 of the regulation member 510.

Further, when the pinion 200 rotates faster than the output shaft 220 because the pinion gear 210 is driven by the ring gear 100 and consequently, when a force for returning the pinion 200 to the motor-located side is applied thereto, due to the difference between the number of rotations of the pinion gear 210 and the ring gear 100, the thrust bearing 232 absorbs the difference between the number of rotations of the plate 230 and that of the regulation claw 511 of the regulation member 510. Thus, it is possible to suppress the generation of abrasion, heat, and rotational loss between the plate 230 and the regulation claw 511 of the regulation member 510.

The foregoing embodiments described hereinabove is not restrictive but may be modified or altered further without departing from the scope and spirit of the present invention.

What is claimed is:

1. A starter for starting an engine having a ring gear, comprising:

a starter motor;

an output shaft to be driven by the starter motor;

first moving means movably coupled with the output shaft by means of a helical spline and having a pinion gear engageable with the ring gear;

second moving means positioned closer to the starter motor than the pinion gear is and movable along the output shaft;

elastic means connected with the first moving means at one end thereof and connected with the second moving means at the other end thereof and elastic in a rotational direction of the output shaft; and regulation means movable to contact with and regulate a rotation of the second moving means thereby to move the first moving means toward the ring gear together with the second moving means and the elastic means by a rotation of the output shaft, wherein the first moving means is constructed to be rotatable by more than ½ pitch of the pinion gear with respect to the second moving means by a flexing of the elastic means in the rotational direction of the output shaft, when the pinion gear contacts the ring gear.

2. The starter according to claim 1, wherein:

the elastic means is elastic in an axial direction of the output shaft to allow a relative movement of the first moving means and the second moving means in the axial direction of the output shaft.

3. The starter according to claim 2, wherein:

the first moving means includes the pinion gear engaging a helical spline formed on the output shaft, and an elastic means-holding part engaging the helical spline and connected with the elastic means, thus holding the second moving means through the elastic means; and the pinion gear is separate from the elastic means-holding part.

4. A starter for starting an engine having a ring gear, comprising:

a starter motor;

an output shaft to be driven by the starter motor;

first moving means movably coupled with the output shaft by means of a helical spline and having a pinion gear engageable with the ring gear;

second moving means positioned closer to the starter motor than the pinion gear is and movable along the output shaft;

elastic means connected with the first moving means at one end thereof and connected with the second moving means at the other end thereof and elastic in a rotational direction of the output shaft; and regulation means movable to contact with and regulate a rotation of the second moving means thereby to move the first moving means toward the ring gear together with the second moving means and the elastic means by a rotation of the output shaft, wherein the first moving means is constructed to be rotatable by more than ½ pitch of the pinion gear with respect to the second moving means by a flexing of the elastic means in the rotational direction of the output shaft, when the pinion gear contacts the ring gear, wherein:

the first moving means includes the pinion gear engaging a helical spline formed on the output shaft, and an elastic means-holding part engaging the helical spline and connected with the elastic means, thus holding the second moving means through the elastic means; and the pinion gear is separate from the elastic means-holding part.

5. A starter for starting an engine having a ring gear, comprising:

a starter motor;

an output shaft to be driven by the starter motor;

first moving means movably coupled with the output shaft by means of a helical spline and having a pinion gear engageable with the ring gear, second moving means positioned closer to the starter motor than the pinion gear and movable along the output shaft;

elastic means connected with the first moving means at one end thereof and connected with the second moving means at the other end thereof and elastic in a rotational direction of the output shaft; and regulation means movable to contact with and regulate a rotation of the second moving means thereby to move the first moving means toward the ring gear together with the second moving means and the elastic means by a rotation of the output shaft, wherein the first moving means is constructed to be rotatable by more than ½ pitch of the pinion gear with respect to the second moving means by a flexing of the elastic means in the rotational direction of the output shaft when the pinion gear contacts the ring gear, wherein:

the regulation means is movable to a position, which is rearward of the second moving means, to prevent a rearward movement of the first moving means when the pinion gear engages the ring gear.

6. The starter according to claim 5, further comprising:

a thrust bearing interposed between the second moving means and the regulation means for absorbing a difference between a number of rotations of the second moving means and that of the regulation means.

7. A starter for starting an engine having a ring gear, comprising:

a starter motor;

an output shaft to be driven by the starter motor;

a pinion gear movably coupled with the output shaft by means a helical spline and engageable with the ring gear of the engine;

a plate movable toward the ring gear;

elastic means for elastically interlocking the pinion gear and the plate with each other; and regulation means movable to contact the plate to regulate a rotation of the plate for moving the pinion gear toward the ring gear together with the plate and the elastic means by a rotation of the output shaft, wherein the elastic means is elastic in a rotational direction of the output shaft due to the rotation of the output shaft when the pinion gear contacts the ring gear.

8. The starter according to claim 7, wherein:

the regulation means includes a claw which is rigid and movable radially relative to the plate; and the elastic means includes a spring formed to extend spirally between the pinion gear and the plate along an axial direction of the output shaft.

9. The starter according to claim 1, wherein:

said elastic means is connected at said one end and said other end thereof so as to maintain said first moving means and said second moving means interconnected as a unit while allowing said rotation of said first moving means relative to said second moving means when the pinion gear contacts the ring gear.

* * * * *